United States Patent [19]

Kronberger et al.

[11] Patent Number: 4,819,871

[45] Date of Patent: Apr. 11, 1989

[54] PROCESS OF MANUFACTURING A FUEL INJECTION NOZZLE BODY AND APPARATUS FOR CARRYING OUT THE PROCESS

[75] Inventors: Maximilian Kronberger, Steyr; Edwin Till, Asten, both of Austria

[73] Assignee: Voest-Alpine-Friedmann Gesellschaft M.B.H., Linz, Austria

[21] Appl. No.: 921,195

[22] Filed: Oct. 21, 1986

[30] Foreign Application Priority Data

Oct. 22, 1985 [EP] European Pat. Off. ..... 85890262

[51] Int. Cl.[4] ..... B21K 1/20; F02M 55/00

[52] U.S. Cl. ..... 239/533.3; 29/157.1 R; 29/157 L

[58] Field of Search ..... 239/533.2-533.12, 239/5, 591, DIG. 19; 29/157.1 R, 157 C, DIG. 49; 72/479

[56] References Cited

U.S. PATENT DOCUMENTS

| | | | |
|---|---|---|---|
| 2,241,735 | 5/1941 | Redsecker | 29/DIG. 49 |
| 3,270,410 | 9/1966 | Salter et al. | 29/446 |
| 4,083,498 | 4/1978 | Cavanagh et al. | 239/533.3 |
| 4,494,700 | 1/1985 | Dolene | 239/533.3 |
| 4,639,568 | 1/1987 | Check et al. | 239/533.3 X |

FOREIGN PATENT DOCUMENTS

| | | | |
|---|---|---|---|
| 1583992 | 6/1971 | Fed. Rep. of Germany . | |
| 2157823 | 11/1971 | Fed. Rep. of Germany . | |
| 3302220 | 6/1984 | Fed. Rep. of Germany . | |
| 2283324 | 10/1976 | France . | |
| 2328854 | 10/1976 | France . | |
| 133824 | 10/1980 | Japan | 29/DIG. 49 |
| 150473 | 8/1985 | Japan | 239/533.3 |

*Primary Examiner*—Andres Kashnikow
*Assistant Examiner*—Kevin P. Weldos
*Attorney, Agent, or Firm*—Cushman, Darby & Cushman

[57] ABSTRACT

To improve the strength properties of the seat face (4) of a nozzle body (1), which seat face cooperates with the tip of a nozzle needle (2) and contains the mouths of fuel injection holes (5), it is proposed to effect a plastic deformation of the nozzle body (1) beyond the yield point adjacent to the seat face (4) for the nozzle needle in such a manner tha the plastic deformation is effected only in part of the wall thickness of the nozzle body adjacent to the seat face (4) for the nozzle needle. To effect that plastic deformation, a mandrel consisting particularly of the nozzle needle (2) is used as a tool. Adjacent to the seat face (4) for the nozzle needle that mandrel has preferably a multiconical or crowned shape. The apparatus for carrying out the process comprises an abutment (10) for the nozzle body (1) and a hydraulic press (11), by which a nozzle needle (2) can be forced against the associated seat face (4) (FIG. 4).

8 Claims, 6 Drawing Sheets

PROCESS OF MANUFACTURING A FUEL INJECTION NOZZLE BODY AND APPARATUS FOR CARRYING OUT THE PROCESS

BACKGROUND OF THE INVENTION

1. Field of the Invention

This invention relates to a fuel injection nozzle body for fuel injection nozzles for internal combustion engines, particularly for high-speed diesel engines, which body comprises fuel injection holes, which extend from the seat surface for a nozzle needle. The invention relates also to a process of manufacturing such fuel injection nozzle body for internal combustion engines, and to apparatus for carrying out that process.

2. Description of the Prior Art

Fuel injection nozzles in which the fuel injection time is controlled by axially nozzle needles are known in the art. In those known designs the fuel injection holes extend either from a blind bore below the valve seat or from the region of the valve seat itself. In embodiments in which the fuel injection holes extend from the blind bores, an afterdripping has been observed. The afterdripping fuel is not adequately atomized and for this reason cannot be burnt so that the economy of the fuel consumption is reduced and the emission behavior, particularly the emission or unburnt hydrocarbons, is deteriorated.

In order to oppose such afterdripping it has already been proposed to arrange the fuel injection holes in the region of the seat for the nozzle needle. But the provision of fuel injection holes in the seat face itself gives rise to a number of manufacturing problems, which can be solved only with difficulty, and such fuel injection holes provided in the seat surface have always involved a high risk of fraction in experiments conducted in the past. For this reason nozzles formed with drilled holes in their seats are not made in series for high-speed diesel engines.

The stresses which arise in the material of the nozzle needle body adjacent to the seat for the nozzle needle and which may result in a fracture of the nozzle needle body consist of a number of individual stresses, which will be listed hereinafter by way of example. A pulsating hydrostatic pressure under an average supply pressure of about 200 bars will particularly give rise to high peripheral stresses and that pulsating hydrostatic pressure will obviously result also in high dynamic pressure peaks. In order to ensure a sealing of the fuel injection holes after the predetermined fuel injection time, the nozzle needle must impinge on the seat for the nozzle needle at relatively high velocity. The resulting longitudinal stresses in the nozzle needle body are superimposed on the high peripheral stresses which are due to the hydrostatic pressure. The fuel injection holes give rise to a pronounced notch effect so that any fracture will usually begin at the fuel injection holes. Besides, cavitation is often caused by the fuel at the entrance end of the fuel injection holes and gives rise to intergranular notches so that the inherent notch effect is inreased by the fuel injection holes. During operation, the outside surface of fuel injection nozzle bodies for internal combustion engines is exposed to temperature of an order of 350° C. so that a relatively distinct temperature gradient is obtained over the wall thickness of the nozzle needle body and steeply decreases inwardly. There is also a corrosion by hot gases inside the nozzle body because combustion gases enter through the fuel injection holes.

The cooperation of pulsating tensile stresses on three axes and of notch effects and corrosive actions is particularly undesirable.

A number of pressure and temperature treatments for tubes have been disclosed by which the strength properties of the walls of tubes can be improved. In particular, Published German Application No. 15 83 992 proposes to increase the strength of thick-walled tubes by a process comprising a plurality of consecutive operations in which, inter alia, a ball is driven through a tube having a nominal inside diameter which is smaller than the outside of the ball. It has also been disclosed to transform those zones within a tube which are loaded by pressure and stress by suitable combined temperature and pressure treatments through the tube thickness to a defined initial condition, which involves a tensile stress on the outside and a compressive stress on the inside.

In order to prevent a corrosion by hot gases inside the nozzle body the valve must close before the pressure in the combustion chamber, outside the nozzle body, exceeds the pressure inside the nozzle body. For this reason the closing of the valve must begin early and must be as fast as possible.

The closing begins as soon as the hydraulic force acting on the valve needle has decreased below the force of the closing spring. Because the hydraulic pressure acts on a larger surface area when the needle is open than when it is closed—the ratio of said surfaces is the closing ratio—the closing pressure will always be lower than the opening pressure. To ensure that the closing begins early, the seat diameter must be as small as possible although this will increase the pressure per unit of area of the valve seat.

A fast closing of the needle requires a hard closing spring, which will increase the impact of the needle on the valve seat.

From the aspect of strength as early and quick closing was not possible in the prior art.

SUMMARY OF THE INVENTION

It is an object of the invention to provide fuel injection nozzle bodies which have drilled holes in their seat and in which the strength has been increased to such a degree that the valve needle can be closed suddenly even when the fuel injection pressure is high and has a desirable seat ratio. In order to accomplish that object the fuel injection nozzle body is so designed in accordance with the invention that the seat face for the nozzle needle has inherent compressive stresses between 50 and 300 $N/mm^2$, which from the seat face decrease to approximately zero over a depth of 30 to 70% of the wall thickness.

For the manufacture of nozzle bodies which will resist all stresses, also the action of corrosive gases, the process in accordance with the invention is substantially characterized in that the nozzle body is deformed adjacent to the seat face for the nozzle needle beyond the yield point by means of a mandrel acting on the sealing surface of the nozzle body and the plastic deformation is effected only in part of the wall thickness of the nozzle body adjacent to the seat face for the nozzle needle. Because the nozzle body is deformed beyond the yield point adjacent to the seat face for the nozzle needle, residual stresses will be left on the inside of the nozzle body adjacent to the seat face after a relaxation since the portions which have been plastically deformed are stressed in compression by the outwardly disposed zones which have been elastically deformed. Owing to said residual inherent stresses, any peak stresses will reliably be taken up and the inherent compressive stresses adjacent to the fuel injection holes will greatly reduce the notch effects. That local strength increase permits also a decrease of the diameter of the needle because the pressure applied by the valve needle per unit of area can be increased. This results in a more favorable seat ratio and, within certain limits, in a smaller mass of the nozzle needle so that a faster closing is permitted. In order to ensure such plastic deformation, which should be effected only in part of the wall thickness of the nozzle body adjacent to the seat for the nozzle needle, in nozzles having a size such as is used for high speed diesel engines, forces between 3000 N and 7000 N, preferaby of 5000 N, are preferably applied in such a manner that the rise from 0 to the nominal value within 0.5 to 3 second, preferably 1 second. The nozzle body usually consists of a tough special steel which has a high strength at high temperature and a high corrosion resistance at high temperature and which may be case-hardened or nitrided before it is treated.

The treatment should be restricted substantially to the region of the seat for the nozzle needle and can simply be effected by means of a mandrel having a shape which matches the seat face. The mandrel may be conical or crowned or multiconical and the extent of the plastic deformation can be concentrated to specific regions of the seat face if a suitable geometry is adopted. As a result, the zones having the highest initial compressive stresses can be shifted into the region of the mouths of the fuel injection holes. For that purpose the process is preferably carried out in such a manner that the mandrel is crowned and so designed that before the deformation the mandrel will contact the seat face along a circle which is adjacent to the fuel injection holes. By such a process the highest inherent compressive stress can be obtained in the region of the fuel injection holes and the working surfaces of the mandrel will be crowned to the largest extent at that point at which the tool will contact the seat face along a circle in which the upper edges of the fuel injection holes are disposed. As a result, the highest inherent compressive stress will be obtained at the point where the highest peripheral stress peak will occur and slightly above that point, i.e., at the point where the strongest impact of the needle, which is increased by the desired favorable seat ratio, is effected. The optimum location of the maximum initial compressive stress can exactly be adjusted by the selection of the crowned shape.

A crowned contour can approximately be obtained by a part-polygoal series of lines so that the mandrel has a multiconical shape. A mandrel having such a multiconical shape can be made in a much simpler manner and at lower cost and the stress pattern will not be adversely affected because the angles of different frustoconical surfaces will differ only slightly.

Within the scope of the process in accordance with the invention the deformation can be effected in a particularly simple manner by means of the nozzle needle. That nozzle needle may have a conical, multiconical or crowned seating surface. In that case a separate tool will not be required and an exact guidance of the needle in the upper portion of the nozzle body will be ensured. There will be no need for a separate tool guide and a simple hydraulic press can be used. In that embodiment of the process an exact seating of the valve needle will be obtained even when the needle has not been made to a high precision. Owing to the snug contact between the needle and the seat face, the sealing surfaces, i.e., that portion of the seat face which is disposed over the mouth of the fuel injection hole, are embossed by each other so that they will effect a particularly good seal during the subsequent operation. As a result, the sealing gap may be shorter and this wall improve the seat ratio.

The apparatus for carrying out the process in accordance with the invention may comprise in a simple manner an abutment for the nozzle body, a mandrel having an outside diameter which matches the inside diameter of the nozzle body and having a conical, multiconical or crowned pressure-applying surface at that end which is to be introduced into the nozzle body, and an axial drive, particularly a hydraulic cylinder-piston unit or a screw drive, for the free end of the mandrel. Owing to the guide provided for the nozzle needle in the upper portion of the nozzle body, there is no need for a separate guide for the tool and the nozzle needle can obviously be used in a particularly simple manner as a tool.

BRIEF DESCRIPTION OF THE DRAWING

The invention will be explained more in detail hereinafter with reference to illustrative embodiments shown on the drawing, in which.

DETAILED DESCRIPTION OF THE PREFERRED EMBODIMENT

Figure 1:
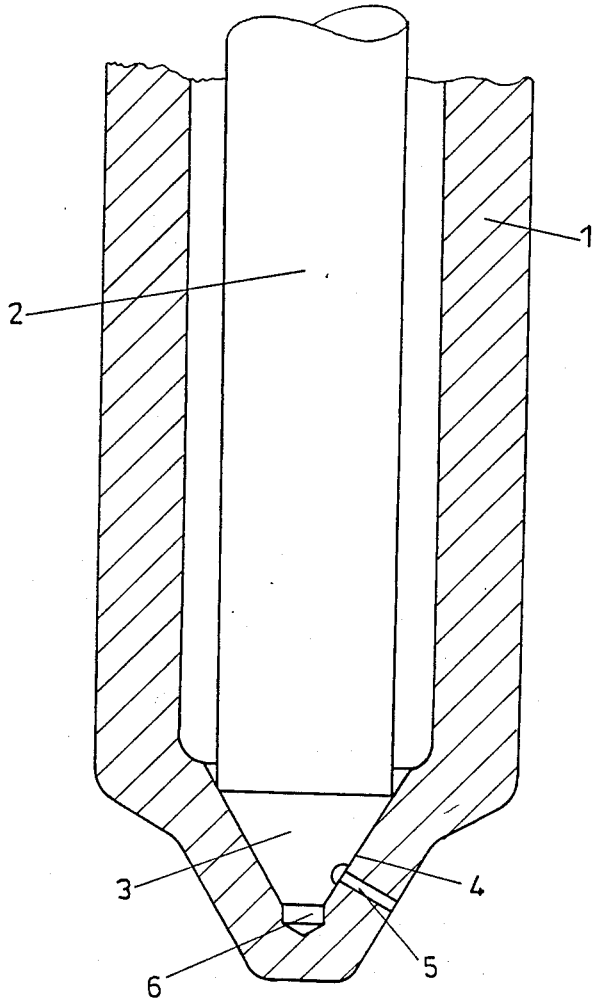
FIG. 1 is an axial sectional view showing a nozzle body and a nozzle needle inserted therein in an arrangement known in the art.

FIG. 1 shows a nozzle body 1 and a nozzle needle 2, which is axially slidable and guided in the nozzle body 1. The nozzle needle 2 has a frustoconical end portion 3, which cooperates with a seat face 4 inside the nozzle body 1. Fuel injection holes 5 are shown, which extend from said seat face 4. The fuel injection holes 5 are opened and closed by an axial motion of the nozzle needle 2. In the showing of FIG. 1 the fuel injection holes are disposed on a relatively small diameter. The seat face 4 terminates in a blind hole 6.

Figure 2:
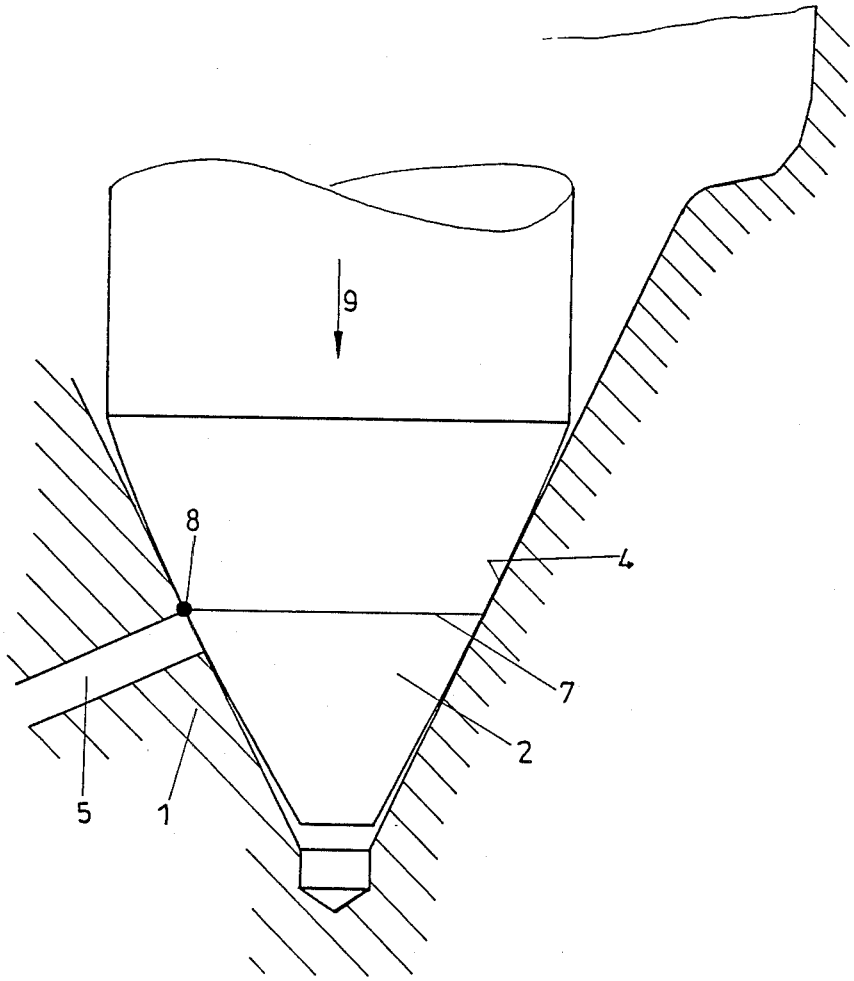
FIGS. 2 and 3 show special shapes of the needle or tool adjacent to the seat for the needle.
Figure 3:
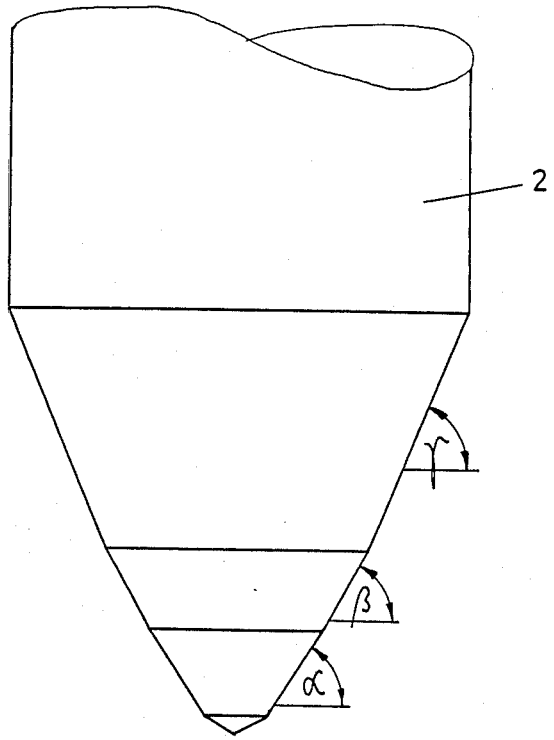

FIG. 2 shows a crowned shape of a tool or nozzle needle 2. The shape is such that when a force is exerted the seat face of the nozzle body is initially contacted along a circle 7 which extends in the region 8 of the upper edges of the mouths of the fuel injection holes. When a tool or a nozzle needle having such a shape is actuated in the direction of the arrow 9, pressure forces will be exerted adjacent to the seat 4 for the needle and the actuation should be such that the forces acting in the direction of the arrow 9 are sufficient for a plastic deformation at least in the region 8 of the seat 4 for the needle. The plastic deformation should not be effected throughout the cross-sectional area or wall thickness of the needle body 1 adjacent to the seat face. Instead of the shape shown in FIG. 2, the needle or tool may have a multiconical shape as proposed in FIG. 3. In that case the nozzle needle 2 has adjacent to the seat for the needle initially a conical surface having a first angle of taper $\lambda$. That surface is adjoined on the side that is opposite to the vertex by a second conical surface at an angle $\beta$, and this is succeeded by a third conical surface at an angle $\gamma$. In this case the design is such that the angle $\alpha$ is smaller than the angle $\beta$ and the angle $\gamma$ is smaller than the angle $\beta$ so that a crowned shape can be approximated by a part-polygonal series of lines.

Figure 4:
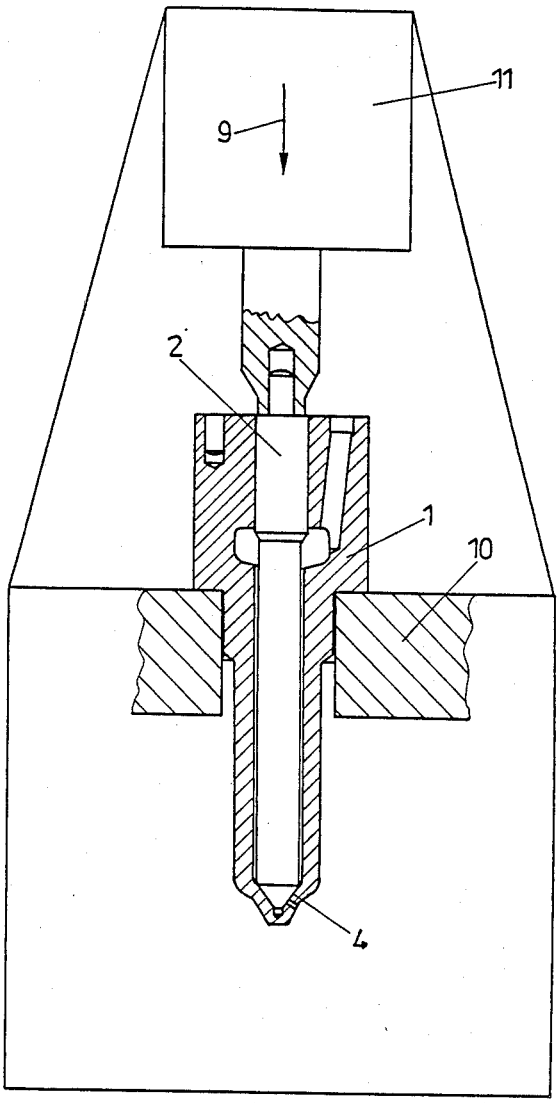
FIG. 4 shows diagrammatically and partly in section an apparatus for carrying out the process in accordance with the invention.

FIG. 4 shows a simple apparatus for carrying out the process in accordance with the invention. The nozzle body 1 is supported by an abutment 10 and a hydraulic press 11 is provided, by which a force in the direction of the arrow 9 can be exerted on a tool or a nozzle needle 2. The tool 2 is guided on the inside diameter of the nozzle body. This will particularly be assumed if the tool is constituted by the nozzle needle 2. The forces applied are effective adjacent to the seat face 4. If the tool or nozzle needle is exactly conical, the forces will be effective particularly at the lower or upper edge of the conical surface. If the tool is more or less crowned, the point which is acted upon can be shifted in height to certain cross-sectional planes so that the desired result will be obtained.

Figure 5:
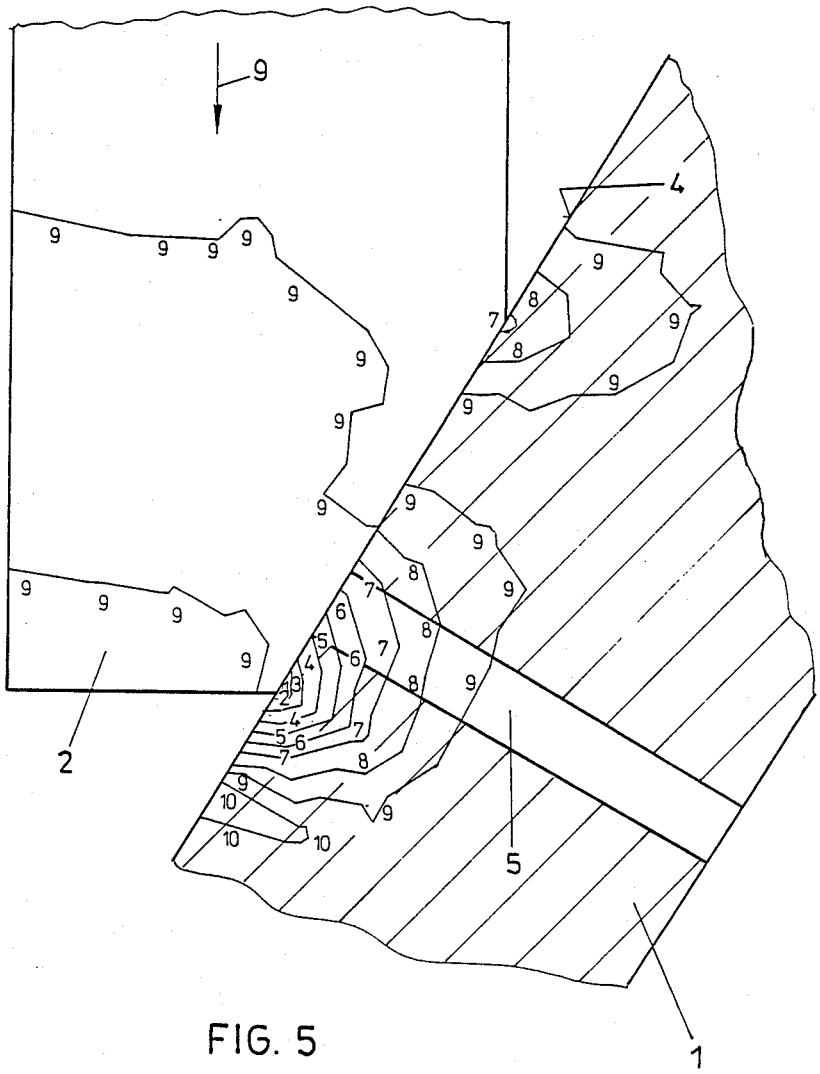
FIG. 5 is a perspective view showing the stresses which are obtained adjacent to the seat face after a shaping force has been exerted by means of a conical tool.

From the diagrammatic representation in FIG. 5 it is apparent how the pressure applied to a tool 2 is effected and which inherent residual stresses will remain after the pressure relief. For this purpose the seat face 4 is shown on a larger scale in FIG. 5. The several series of lines define regions having equal inherent residual stresses in the peripheral direction. The stresses in regions 3 to 8 consist of decreasing compressive stresses, there is a neutral zone 9 and the stresses in the region 10 consist of tensile stresses. A qualitative pattern of that kind will be obtained as a residual stress after a relaxation when a force in the direction of the arrow 9 has been exerted. Stress pattern such as are shown in FIG. 5 can be calculated in advance by the method of finite elements. For the sake of order it is emphasized that the simplified showing in FIG. 5 represents only the residual stresses which act in the peripheral direction and are obtained after the action of a conical tool.

Figure 6:
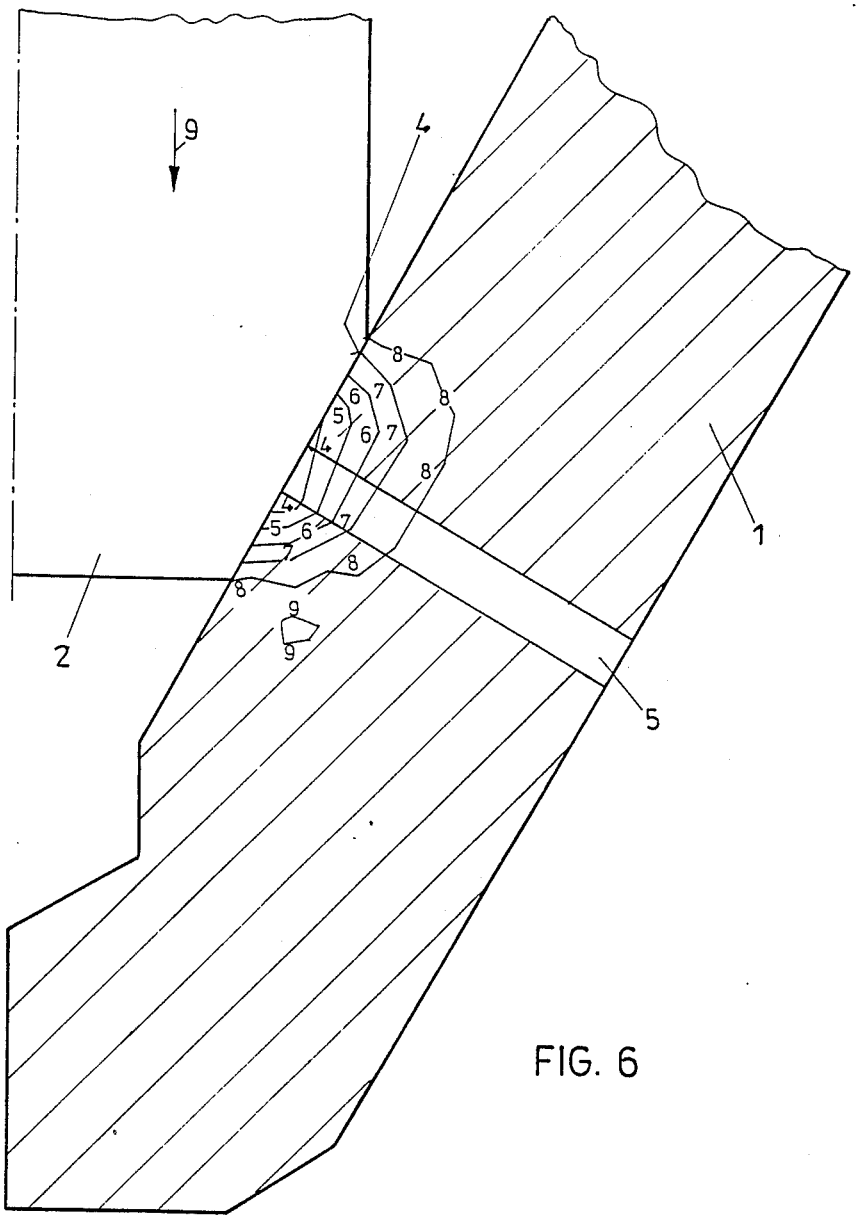
FIG. 6 is a perspective view showing the stresses obtained adjacent to the seat face after a shaping force has been exerted by means of a crowned tool.

FIG. 6 is a showing that is similar to FIG. 5 of the peripheral stresses obtained after the action of a tool having a crowned contour.

For the sake of simplicity, only peripheral stresses have been referred to. It will obviously be possible that stresses acting in other spatial directions and comparison stresses can be calculated with the same methods and can be graphically represented in a similar manner.

we claim:

1. A fuel injection nozzle body for fuel injection nozzles for internal combustion engines, particularly for high-speed diesel engines, the nozzle body having a wall defining a seat face through which fuel injection holes extend, said seat face having inherent compressive stresses between 50 and 300 N/mm$^2$, which from the seat face decrease to approximately zero over a depth of 30 to 70% of the thickness of said wall.

2. A process of manufacturing a fuel injection nozzle body of the kind having a wall defining a seat face through which fuel injection holes extend comprising deforming the nozzle body adjacent to the seat face beyond the yield point of the material of the body by means of a mandrel forced against the seat face, the resulting plastic deformation of the seat face being effected only in part of the wall thickness of the nozzle body adjacent to the seat face so as to effect compressive stresses in the seat face of between 50 and 300 N/mm$^2$ which from the seat face decrease to approximately zero over a depth of 30% to 70% of the thickness of the wall.

3. A process as in claim 2 wherein the deformation is effected by means of a crowned mandrel.

4. A process as in claim 2 wherein the mandrel has such a crowned shape that before the deformation the mandrel will contact the seat face along a circle which is adjacent to the fuel injection holes, and particularly contacts or intersects the fuel injection holes.

5. A process as in claim 2 wherein the mandrel is a nozzle needle.

6. A process as in claim 2 wherein forces between 3000 N and 7000 N are applied to the mandrel to effect the deformation of the seat face.

7. A process as in claim 2 wherein the force is exerted on the seat face at such a variety that the entire force is exerted between 0.5 and 3 seconds after the beginning of the exertion of the force on the seat face.

8. Apparatus for manufacturing a fuel injection nozzle body of the kind having a wall which defines a bore terminating in a seat face and fuel injection holes in the seat face, said apparatus comprising: a support for the nozzle body; a mandrel having a shank portion complementary to the bore in the nozzle and the shank portion having a free end and an opposite end which is a conical, multiconical or crowned pressure-applying surface; and axial drive means for applying an axial force to said free end of said mandrel shank portion, when said mandrel has been inserted into the bore of a nozzle body with said pressure-applying surface contacting the seat face of the nozzle body, that plastically deforms the seat face to effect comprressive stresses between 50 and 300 N/mm$^2$ which from the seat face decrease to approximately zero over a depth of 30% to 70% of the thickness of the wall of the nozzle body.

* * * * *